US006233737B1

(12) United States Patent
Ditchfield et al.

(10) Patent No.: US 6,233,737 B1
(45) Date of Patent: May 22, 2001

(54) CONCEALABLE BALLISTIC VEST

(75) Inventors: Brad Ditchfield, Corona; Richard Carlson, Yorba Linda; Veronique Leveneur, Los Angeles; Roger Min, Buena Park, all of CA (US)

(73) Assignee: Safari Land Ltd., Inc., Ontario, CA (US)

( * ) Notice: Subject to any disclaimer, the term of this patent is extended or adjusted under 35 U.S.C. 154(b) by 0 days.

(21) Appl. No.: 09/492,944

(22) Filed: Jan. 27, 2000

Related U.S. Application Data

(63) Continuation of application No. 09/394,216, filed on Sep. 13, 1999, now abandoned.
(60) Provisional application No. 60/117,819, filed on Jan. 29, 1999.

(51) Int. Cl.[7] ..... A41H 1/02; A41D 13/00
(52) U.S. Cl. ..... 2/2.5; 428/911; 89/36.05
(58) Field of Search ..... 2/2.5, 102, 69, 2/69.5, 96, 97, 94, 247; 89/36.01, 36.02, 36.05; 428/911

(56) References Cited

U.S. PATENT DOCUMENTS 3,557,384 * 1/1971 Barron et al. ..... 2/2.5
3,559,210 * 2/1971 Hansen ..... 428/911
4,425,667 * 1/1984 Harrison ..... 2/2.5
5,327,811 * 7/1994 Price et al. ..... 89/36.05
5,373,582 * 12/1994 Dragone et al. ..... 2/2.5
5,378,529 * 1/1995 Bourdeau ..... 2/163
5,431,318 * 7/1995 Garcia ..... 224/192
5,465,424 * 11/1995 Cudney et al. ..... 2/2.5
5,479,659 * 1/1996 Bachner ..... 2/2.5
5,771,489 * 6/1998 Snedeker ..... 2/2.5
5,915,528 * 6/1999 Shmuelov ..... 2/2.5
5,918,309 * 7/1999 Bachner ..... 2/2.5
5,943,694 * 8/1999 Moureaux et al. ..... 2/2.5
5,960,470 * 10/1999 Bachner ..... 2/2.5
6,029,270 * 2/2000 Garcia ..... 2/2.5

* cited by examiner

*Primary Examiner*—John J. Calvert
*Assistant Examiner*—Tejash Patel
(74) *Attorney, Agent, or Firm*—Christie, Parker & Hale, LLP

(57) ABSTRACT

A ballistic vest having a front panel and a rear panel having mating side edge configured in a ball and socket configuration. The front panel has either a concave or convex waistline. The front and rear panels are connected by stretchable neoprene straps with hook and loop fasteners at the end of the straps and on the front and rear panels.

24 Claims, 10 Drawing Sheets

CONCEALABLE BALLISTIC VEST

CROSS-REFERENCE TO RELATED APPLICATIONS

This application is a continuation of Application No. 09/394,216, filed Sep. 13, 1999, now abandoned, which claimed the benefit of U.S. Provisional Application No. 60/117,819, filed Jan. 29, 1999.

FIELD OF THE INVENTION

This invention relates to protective vests, and more particularly, to concealable body armor commonly known as a ballistic vest.

BACKGROUND OF THE INVENTION

Ballistic vests have saved the lives of many law enforcement officers in recent years. As a result, law enforcement agencies have made it mandatory for their officers to wear a ballistic vest while on duty.

Ballistic vests have been available in recent years as a protective panel having overlying layers of a fabric made from woven high tensile strength fibers. Woven fabrics from an aramid fiber known as Kevlar, for example, have been used successfully in ballistic vests because of the high energy absorption properties of the fabric material. The material is also reasonably light in weight and flexible, which provides improved comfort when compared with previous vests which were made of metal and were therefore heavier and more rigid. The comfort of a ballistic vest is extremely important, especially to law enforcement officers, because of the heat build-up that occurs from wearing a heavy and inflexible vest for the long hours an officer is on duty. Resistance to projectile penetration is a principle factor in designing a ballistic vest; and added protective layers can offer greater protection against projectiles having the higher threat levels, but added protective layers also add undesired weight and inflexibility of the vest.

In addition to woven Kevlar fabric layers, ballistic vests have been made from other high strength fibers and composites to reduce weight and improve flexibility of the vest. However, ballistic vests using the lighter, more flexible materials also must offer the required minimum levels of protection against penetration by different types of projectiles.

Ballistic vests are regularly certified by subjecting them to ballistics testing to measure their ability to protect against different projectiles fired from different types of weapons at various angles. One ballistic test commonly used in the industry is the National Institute of Justice (NIJ) Standard 0101.03 Threat Level IIIA, which, in general terms, is a high performance standard requiring that the ballistic vest prevent penetration of specified 0.44 Magnum and 9 mm rounds fired at a velocity of at least 1400 ft/sec. In addition to prevent such projectile penetration, "backface deformation" also is a required test factor in the NIJ Standard 0101.03 Threat Level IIIA certification test. Backface deformation measures the trauma level experienced by a projectile that does not penetrate the test panel. According to this test, the maximum allowable backface signature (bfs) containment for soft body armor requires a maximum allowable bfs of 44 mm for 0.44 Magnum and 9 mm rounds.

There is a need to provide a ballistic vest that is reasonably light in weight, is highly flexible and comfortable, and is also capable of meeting the high performance projectile specifications of, as an example, the NIJ. Providing such a vest at a reasonably low cost for the comparable high performance level also is a desirable objective.

There are other instances where lighter weight vests are more desirable even though they may not meet the Threat Level IIIA standards. Here the challenge is to produce a lightweight vest capable of meeting the certification standards of NIJ Threat Levels II and IIA. An extremely lightweight vest with an areal weight less than one pound per square foot that meets Level II and IIA standards is desirable.

Such a vest design which meets these requirements is disclosed in applicant's U.S. Pat. No. 5,619,748. The disclosure of which is incorporated herein by reference. The vest of the '748 patent is marketed by Safari Land Ltd., Inc. under the trade name Hyperlite and is a concealable ballistic vest.

Problems associated with currently available concealable soft body armor ballistic vests include the vest not being designed to accommodate different body types. Body type 1 is a type wherein the waist measurement is significantly greater than the chest measurement. Body type 2 comprises a chest measurement and a waist measurement which are substantially similar. Body type 3 comprises a chest measurement which is substantially greater than a waist measurement. Previous concealable ballistic vests were designed to accommodate body type 2. The vests do not optimally accommodate body type 1 and body type 3 wearers. Consequently, standard designs either inadvertently expose areas of the body or provide an uncomfortable fit for the wearer.

Another problem of existing concealable ballistic vests is that they are manufactured from materials which do not facilitate the removal of body moisture produced when wearing the vest for prolonged periods of time. Another problem associated with current vests is that their construction provides for the ballistic package to be contained within a carrier which is sewn around the ballistic packages which prevents the ballistic material from extending to the edges of the carrier thereby preventing the ballistics material from covering the entire body. Another problem associated with prior concealable ballistic vests is that the strapping utilized to adjust the fit of the vest is made from elastic and Velcro which cannot be shaped or contoured, or provide multidirectional movement thereby providing for a less than desirable fit.

Another drawback from currently available ballistic vest designs is the inability to comfortably fit a female wearer. Pleats and darts which create seams were required to accommodate the bust. Added seams detract from comfort and fit. Variation in anatomy among women also prevented a single vest design from uniformly fitting all women wearers.

Consequently, a need exists for an improved concealable vest design which addresses the drawback of previous vest designs.

SUMMARY OF THE INVENTION

The present invention provides a ballistic vest of the soft body armor type preferably comprising a plurality of overlying first flexible layers arranged in a stack on a strike side of the vest, and a plurality of overlying second flexible layers arranged in a stack on a body side of the vest. Preferably, each first flexible layer comprises a thin, flexible, woven fabric layer made of high tensile strength polymeric fibers. The individual woven fabric layers are secured to each other as a unit to form a soft, flexible woven fabric first panel for the vest. Preferably, each second flexible layer comprises a thin, flexible imperforate fiber-reinforced plastic sheet comprising an array of plastic fibers embedded in a thermoplastic resinous matrix that forms each film sheet. The second layers overlie each other substantially without attachment to one another and as a combination are referred to as a second panel of the vest. The first and second panels are both located in the front and rear of the vest. Although this is a preferred ballistics package, any type and number of ballistic packages which meet any threat level are contemplated for use in the present invention. The vest of the present invention preferably is designed to be concealable, however it is to be understood that the inventive concepts are equally applicable to ballistic vests which are worn on the outside of the wearers' clothing or uniforms.

The ballistic vest of the present invention incorporates a design having a trapezoidal center panel with hook compatible fabric sewn to the sides and top of the trapezoid. Nylon hook fasteners with rounded ends are incorporated to fasten the front panel to the back panel, and are attached to stretch neoprene strapping which is utilized in place of conventional elastic. The ballistic vests of the present invention employs a unique grading method providing improved fit to a wide range of body types. More precise fit improves the wearers comfort, and as a result, more effective body armor is created.

The ballistic vests of the present invention incorporates an improved shape of the ballistic panels and the carrier wherein the radius along the bottom edge of the panel and carrier changes from concave to convex to accommodate body type 3 and body type 1 respectfully. The effect of the changing radius is a conical shape matching the contours of the bodies of various wearers. In addition, the sides of the front panel and the back panel are designed to include a ball and socket arrangement wherein one of the edges of the front or the back has a concave shape and the other edge is a convex shape thus forming a ball and socket connection to provide continuous ballistic protection along the side of the vest for either body types 1, 2 or 3 when worn.

The ballistic vests of the present invention also enables body moisture to be transferred from the body side to the outside of the ballistic panel inserts, thus providing evaporative cooling effect. As a result, the armor is cooler, making it more wearable. The lining of the ballistic vests is constructed with material designed to wick moisture. The wicking fabric wraps from the body side of the ballistic panel to the outside shell of the vest. Perspiration is absorbed by the lining and transferred around the ballistic panels to the strike side of the vest for evaporation.

The ballistic vest of the present invention also includes an improved carrier design to fit the vest to the ballistic shape thereby reducing the areas that do not contain ballistic materials. The ballistic carrier is constructed so that all sewn seams are on the inside of the carrier and away from the edge of the ballistic packages which reduces the finished size of the carrier and provides for the ballistic packages to extend to the edges of the vest allowing increased ballistic surface. The carrier has also been designed to incorporate the use of laminated neoprene and nylon composite materials as strapping to secure the ballistic panels to the body. The laminated neoprene and nylon composite provides for multi-directional adjustment and adjustability to provide an optimum fit on the wearer. Multi-directional flexibility improves fit, comfort and control of the ballistic panels.

The carrier of the ballistic vest also incorporates low profile hook compatible fabric which improves concealment and adjustability. As a result, the armor is less visible and more wearable. The low profile hook compatible fabric is a woven or knit loop pile fabric which mates with hook-type fasteners to secure the garment to the body. This material provides improved multi-directional adjustment of the garment strapping and provides lower profile connection making the garment less visible under uniform shirts. The carrier also eliminates any seams or openings in the vest lining fabric. This produces a smooth surface against the body. The ballistic carrier lining is cut in one continuous piece and internally sewn only to the outside perimeter.

Access to the ballistic packages within the carrier is located on the outside of the garment which produces a smooth surface against the body and a more wearable and comfortable vest. The carrier is constructed with a zipper running across the width of the lower edge. The zippered opening provides easy access to removable ballistic panels or packages. The carrier may also include visual inspection ports on the exterior of the garment. The inspection port allows the wearer to see that the ballistic panels are in place without opening the garment. The inspection ports are preferably constructed of mesh material wherein the ballistic panel can be seen through the mesh.

The ballistic vest of the present invention also is designed with an adjustable and replaceable strapping system. The vest incorporates a system using hook and loop fasteners to permit the removal, adjustment or replacement of straps used to hold the garment and ballistics to the body. The elastomeric strapping at the shoulder and at either side of the waistline mate hook compatible fabric to a hook fastener located within an enclosure. The carrier garment is constructed with openings at the shoulder and sides of the back panel where hook compatible elastomeric strapping is inserted and engaged with hook fastener sewn to the inside of the opening. The desired length can be obtained by moving the strap in or out of the opening before engaging the hook fastener. This system also permits the removal or replacement of the straps as they are of a modular design.

The ballistic vest of the present invention also incorporates the use of stretch fabrics or meshes for tails on both the front and back of the vest which is tucked into uniform trousers. The tails are used to hold the vest down during movement of the wearer. The stretch fabric improves freedom of movement which improves the level of comfort and the effectiveness of the ballistic vest. The flaps or tails are sewn to the bottom hem of the ballistic carrier.

The ballistic vest of the present invention also incorporates a novel female ballistic panel without pleats, darts or seams which is configured to accommodate various bust sizes. The ballistic panel is formed as a flat panel which when worn conforms three dimensionally to the body by incorporating notches along the sides of the panel in the bust area. When the panel is on the body the notches allow the panel to conform to the chest without gaps, folds or overlapping areas.

The invention also includes a novel measuring device comprising a yoke and torso, waist and bust measuring tapes incorporated into the yoke. The measuring device can be quickly used to obtain the torso, waist and bust measurement to construct the appropriately sized vest.

BRIEF DESCRIPTION OF THE DRAWINGS

These and other features and advantages of the present invention will be more fully understood by reference to the drawings and following detailed description wherein.

DETAILED DESCRIPTION

Figure 1:
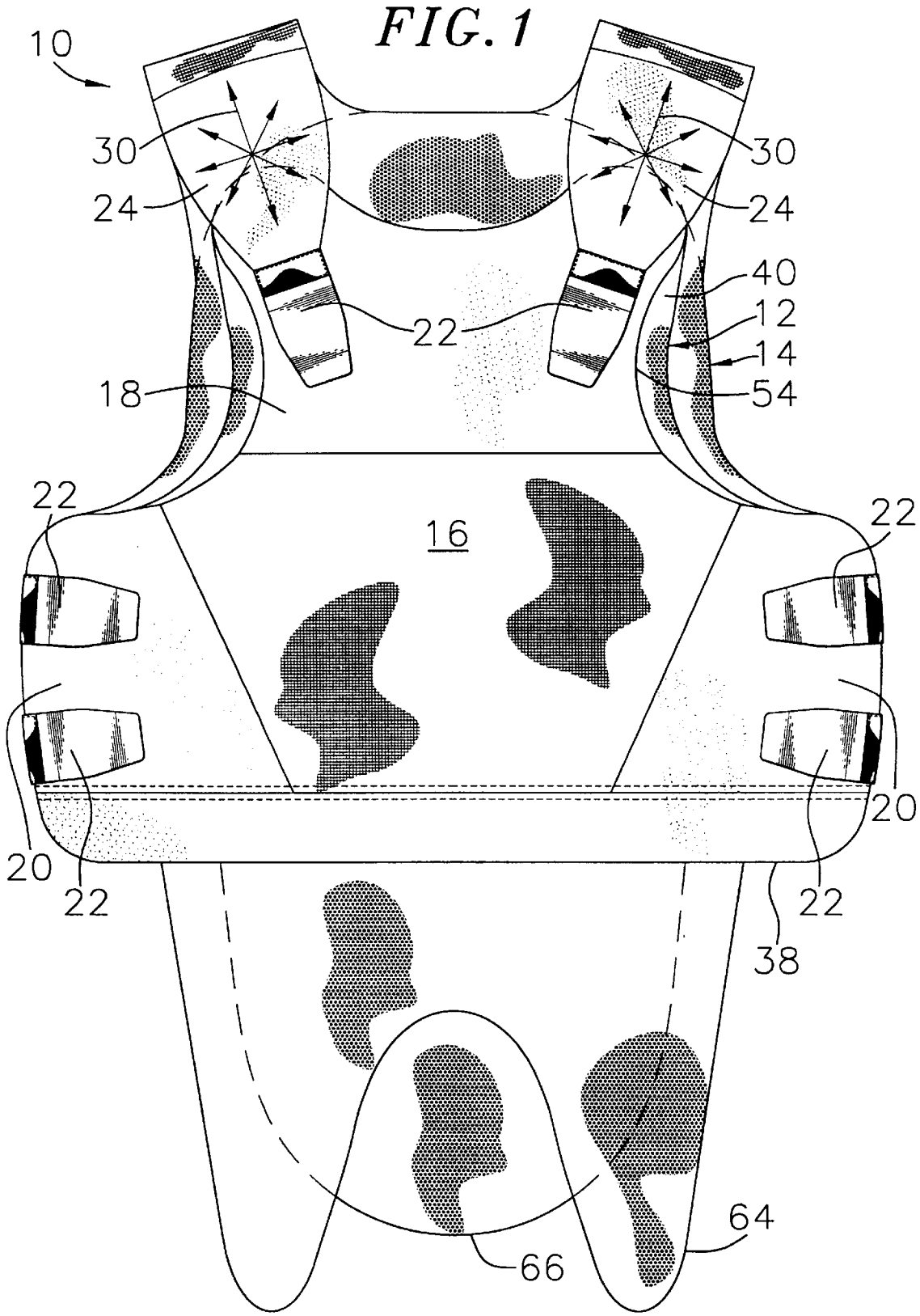
FIG. 1 is a front view of the ballistic vest of the present invention.
Figure 4:
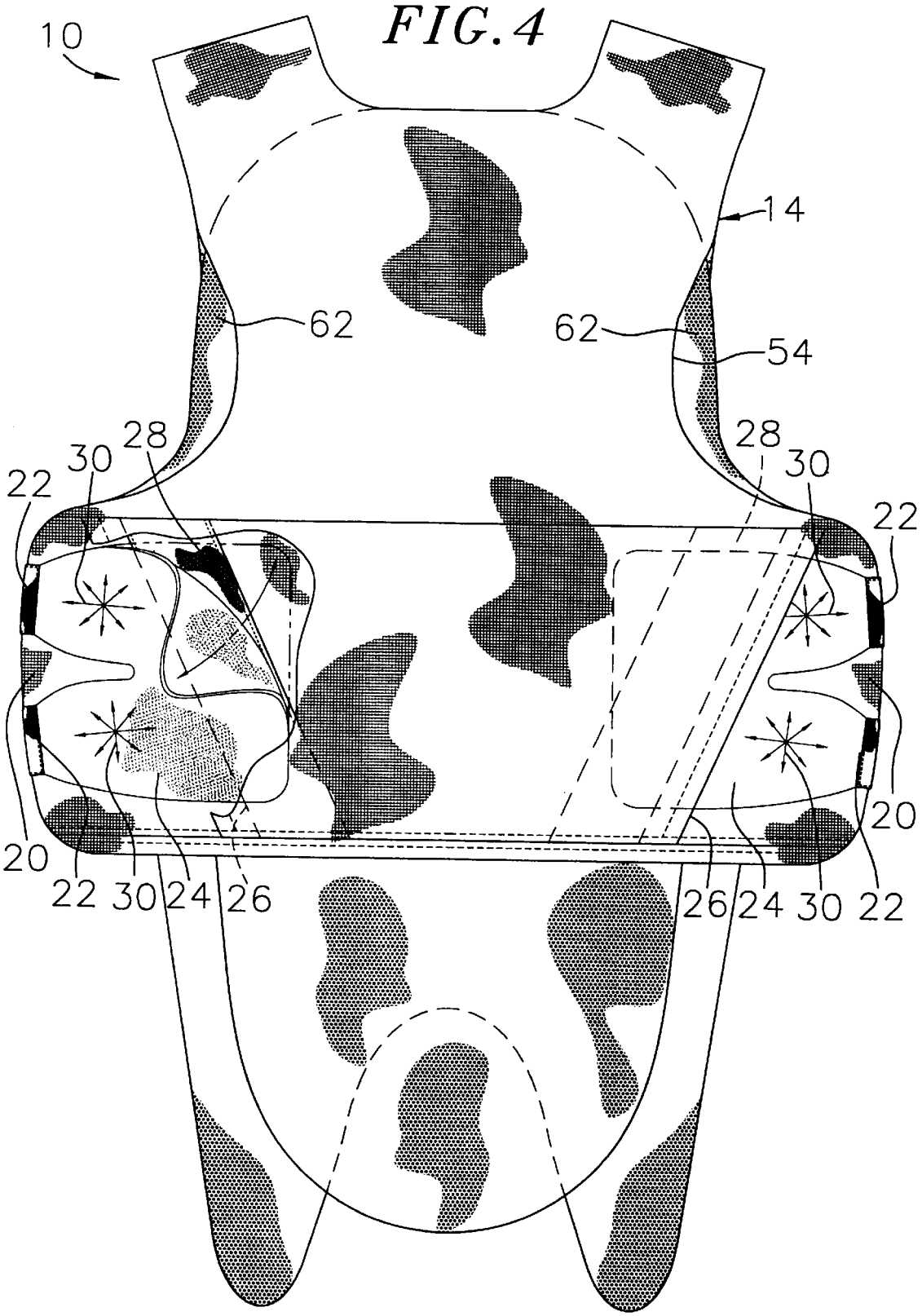
FIG. 4 is a back view of the ballistic vest of FIG. 1.
Figure 5:
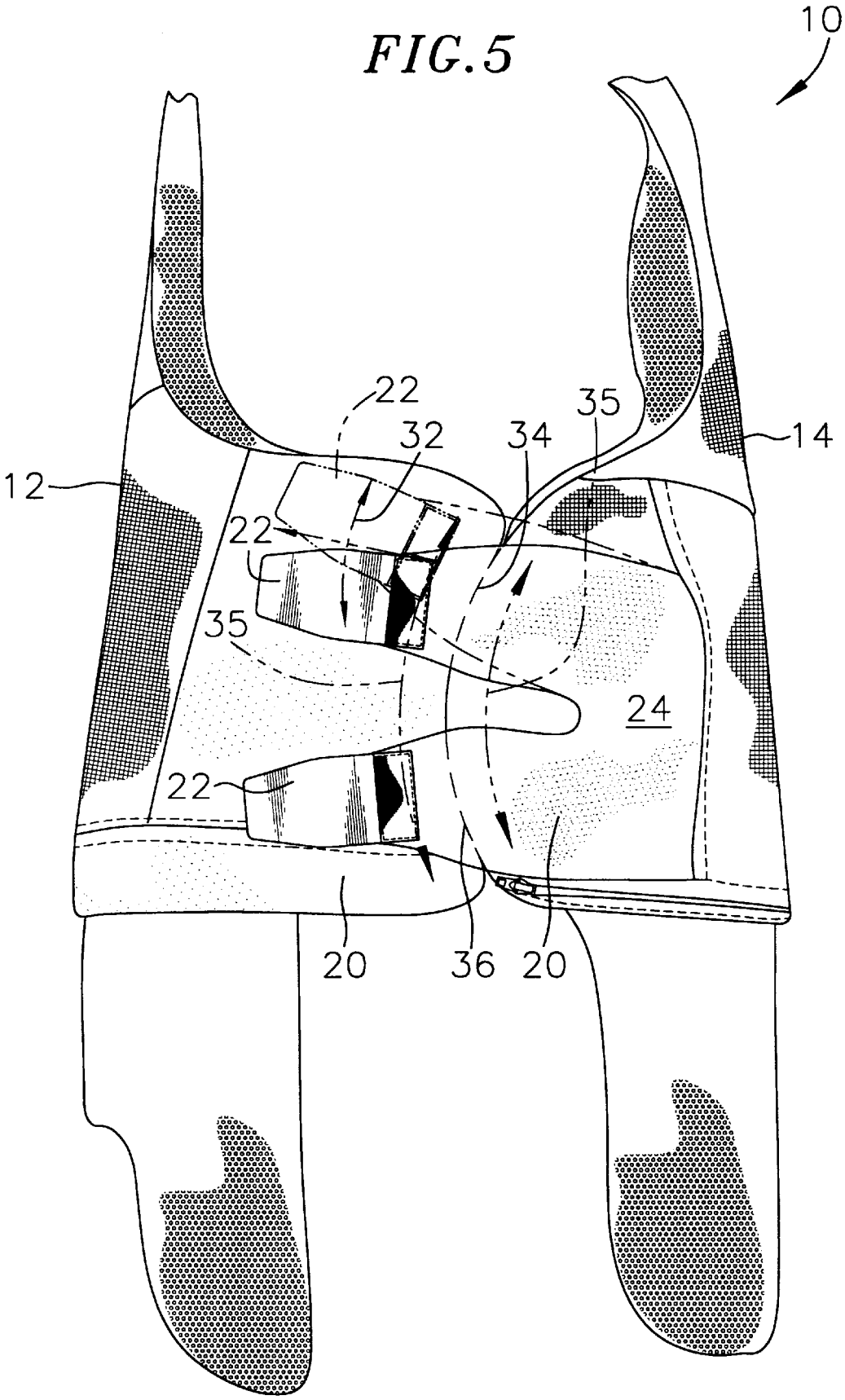
FIG. 5 is a side view of the ballistic vest of FIG. 1.
Figure 6:
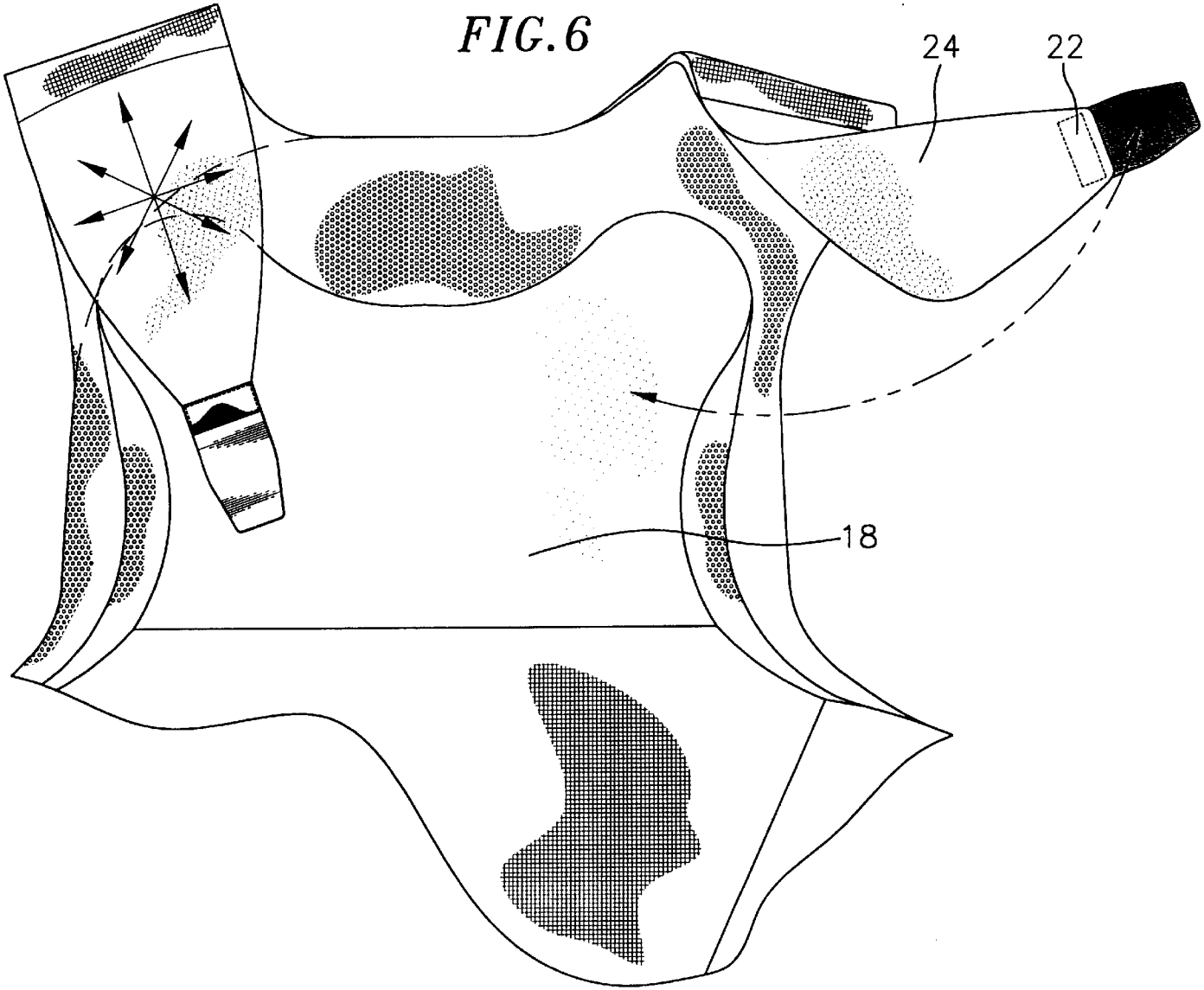
FIG. 6 is a partial front view of FIG. 1 illustrating the strapping system.

The ballistic vest 10 of the present invention is shown in FIGS. 1, 4 and 5. The ballistic vest 10 is a concealable vest of the soft body armor type commonly worn by law enforcement officers. The ballistic vest includes a front panel 12 and a rear panel 14. The front panel 12 protects the chest and stomach of the wearer while the rear panel 14 protects the back of the wearer. Both the front and rear panels protect the sides of the wearer as will be discussed in more detail below.

The front panel 12 includes a trapezoidal center panel 16 and hook compatible fabric located along the top 18 and sides 20 of the front panel 12. Top 18 and sides 20 provide a large area for hook fasteners 22 to secure the front panel and rear panel together around the wearer. Top 18 and sides 20 allow for placement of fasteners 22 at any location to provide an optimal fit for the particular wearer. This is in contrast to previous designs which incorporated small locations for attachment of fasteners. Neoprene composite straps 24 located at the top and sides of the ballistic vest are attached to the fasteners 22 to secure the front and rear panels together. As seen best in FIG. 4, straps 24 for connecting the top of the front and rear panels can be typically sewn to the rear panel and or as with straps 24 located at the sides of the ballistic vest, can be inserted into a pocket 26 which includes a section of hook fasteners 28 sewn within a pocket for connection of the neoprene straps 24. The pocket arrangement for the straps 24 can be located at the top, sides or both locations of the vest. As indicated by the direction arrows 30 the neoprene straps 24 provide for multi-directional adjustment of the straps. In addition, the straps can be formed with a contoured surface to provide for additional comfort of the straps. The strapping 24 is a laminated neoprene and Nylon composite which provides more adaptability and freedom of movement. The neoprene composite is commercially produced by Rubatex of Santa Fe Springs, Calif.

FIG. 5 illustrates the attachment of the fasteners 22 on the side of front panel 12 and shows in phantom and direction arrow 32 how straps can be placed at any location dependent upon the body configuration of the wearer.

Figure 2:
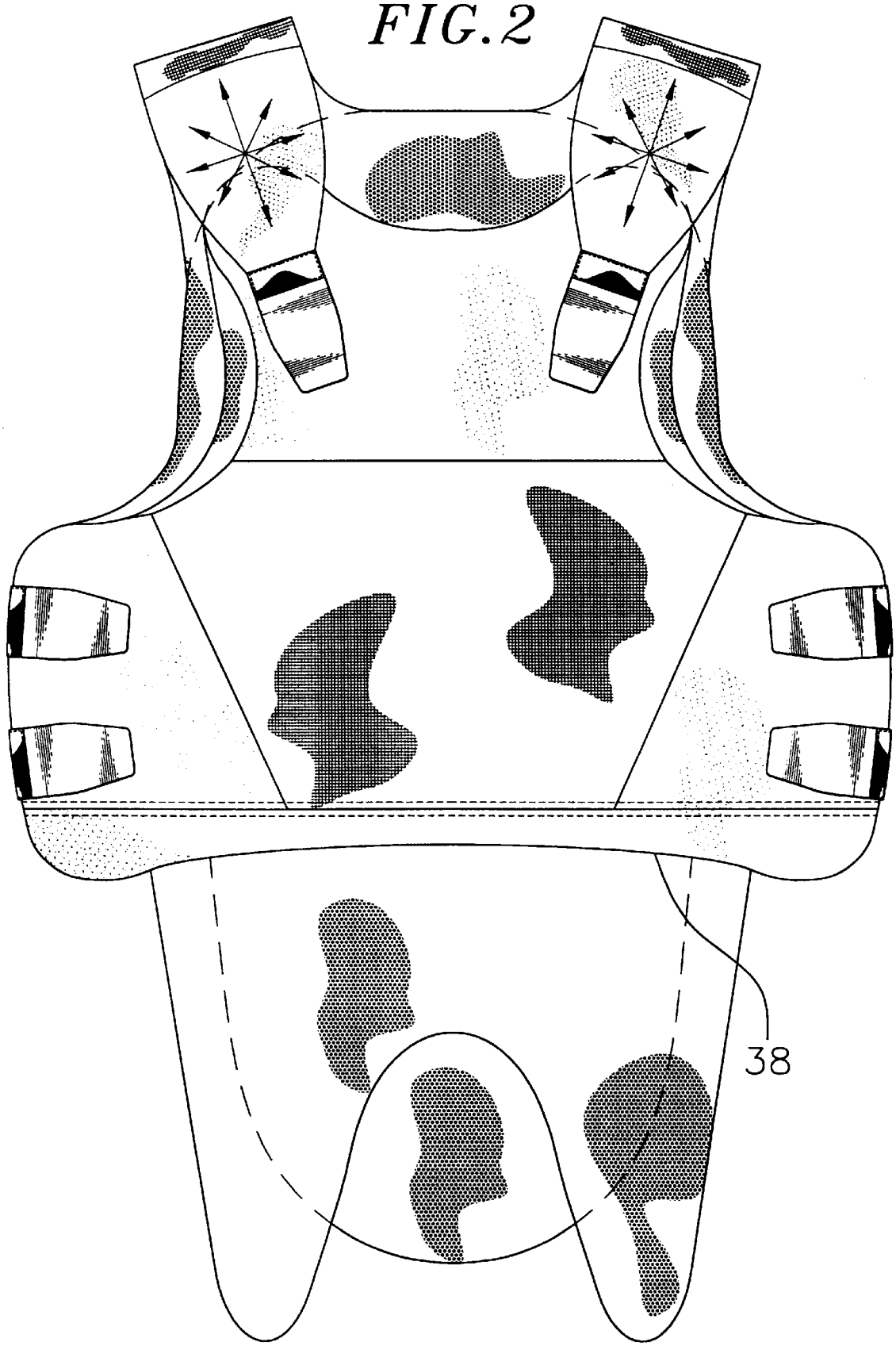
FIG. 2 a first alternative embodiment of the ballistic vest of the present invention.
Figure 3:
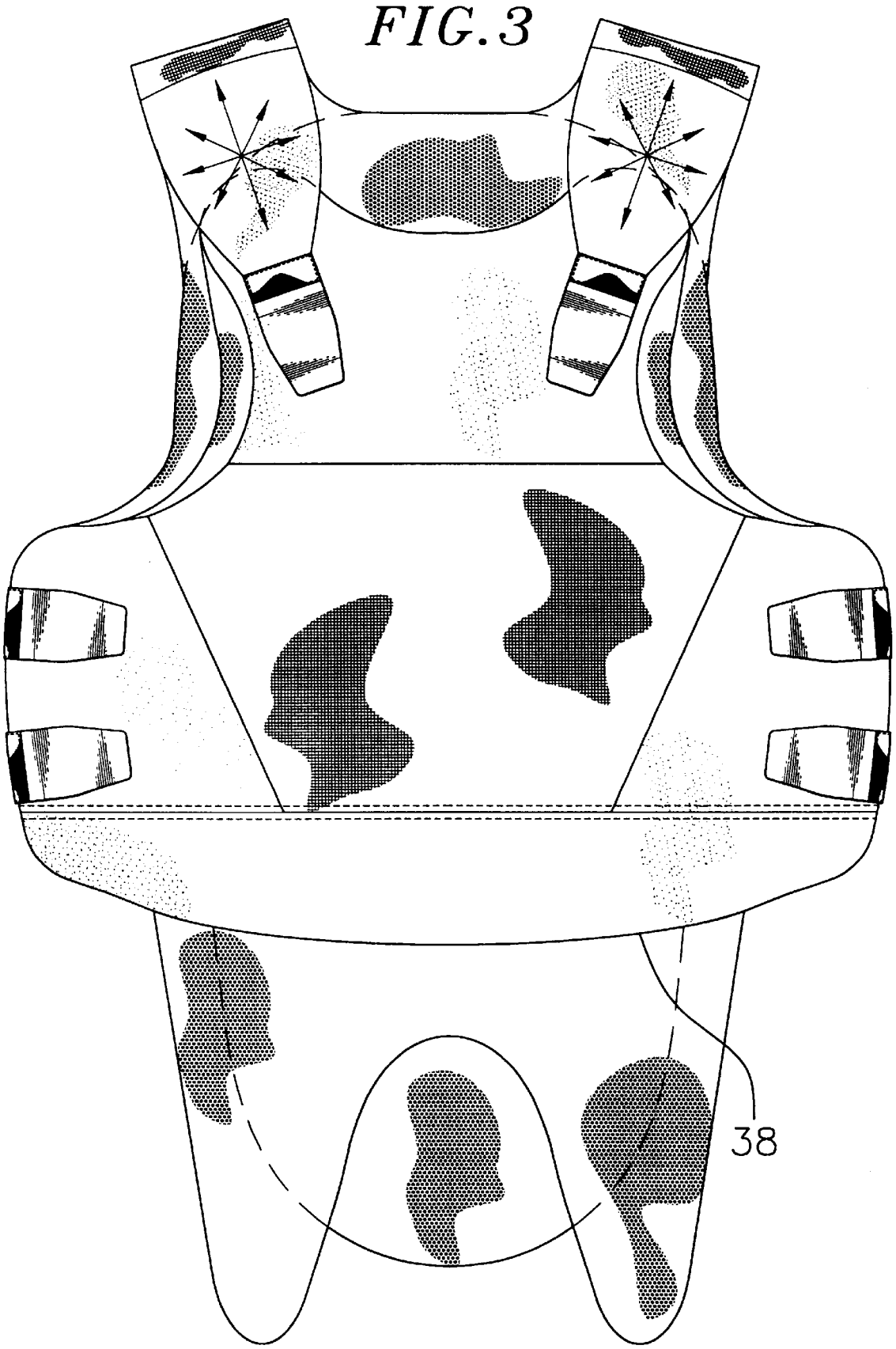
FIG. 3 is a second alternative embodiment of the present invention.

The ballistic vest of the present invention has been designed to accommodate various body types by including a "ball and socket" mating edges 34 and 36 of the front and rear panels respectively. The "ball and socket" is configured on both the carrier and the ballistic panel contained within the carrier of the vest. As shown in FIG. 5, mating edge 34 of front panel 12 has a concave curvature and mating edge 36 of rear panel 14 has a convex curvature to provide a pivot point allowing the front and rear panels to rotate as shown by arrows 35 creating more or less room for the chest and stomach cavities. This pivoting action offers improved fit to the body. To accommodate body type 1 the front and rear panels can rotate to accommodate more room at the waistline and less room in the chest cavity. With respect to body type 3 the front and rear panels can rotate to allow for more room in the chest cavity and less room at the waistline. Thus, complete ballistics protection is maintained on the side which eliminates gapping problems associated with prior art designs and overlap problems which was less comfortable. Either of the front or rear panels can include a concave or convex edge portion with the other panel having the corresponding edge. In combination with the ball and socket arrangement on the sides of the ballistic vest the waistline 38 has been designed to include a concave curvature as shown in FIG. 2 to accommodate body type 3 or a convex curvature as shown in FIG. 3 to accommodate body type 1. In each instance complete ballistic protection is provided for all body types. waistline 38, as shown in FIG. 1 has a conventional straight edge to accommodate body type 2.

Figure 8:
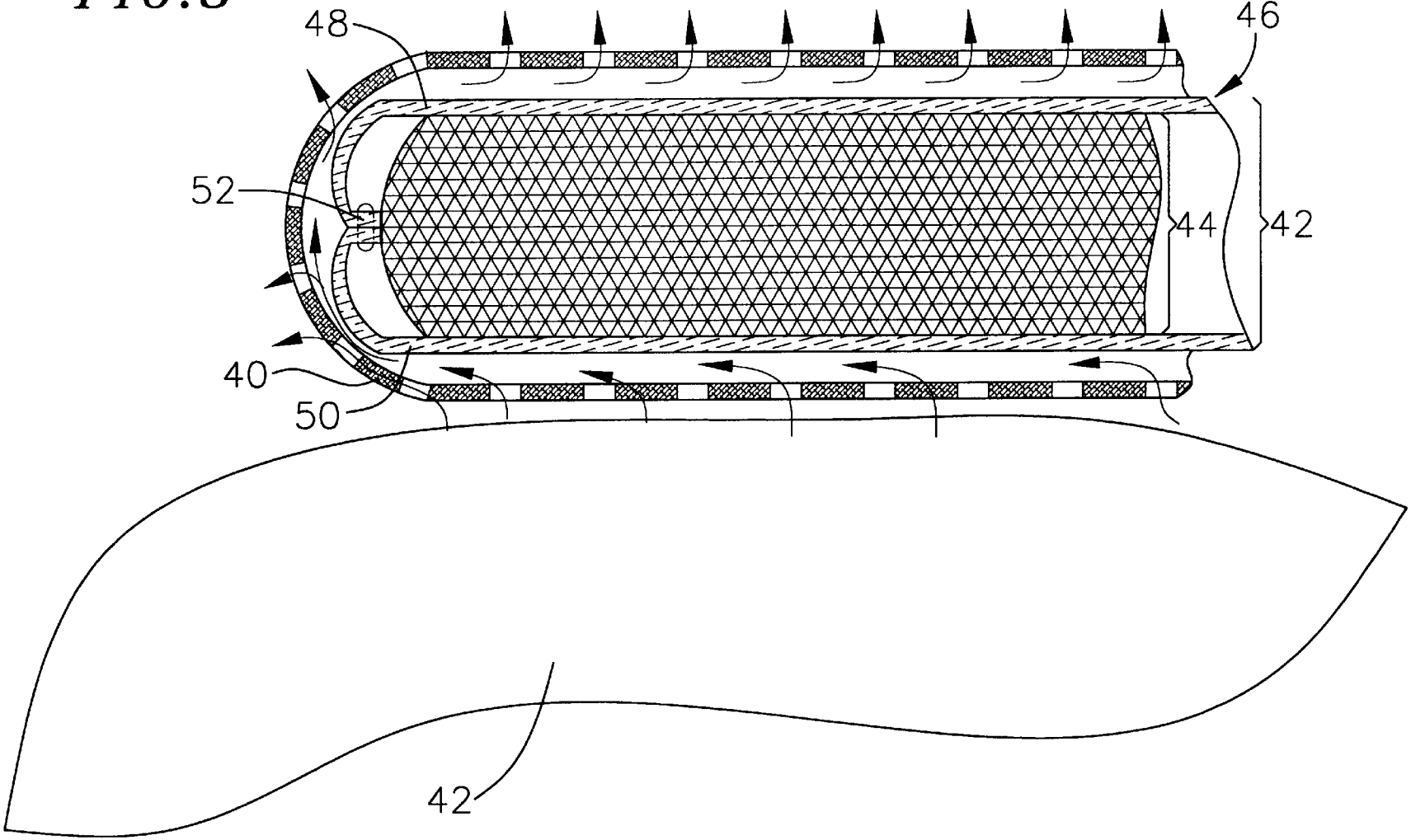
FIG. 8 is a partial cross-sectional view of the front panel of the ballistic vest of the present invention.

As shown in FIG. 8 the front panel, as well as the rear panel, includes a lining material 40 which is adjacent the body 42 of the wearer and extends around the edge of the panel to the outside of the ballistic vest. The material can be perforated or of solid construction and is a moisture absorbing material which wicks moisture away from the body and around to the outside of the vest for evaporation. Body moisture is transferred to provide an evaporative cooling effect. The preferred moisture-absorbing material is an antimicrobial material commercially available under the trade name Microsafe by Rentex, Inc. of Montreal, Canada. Contained within the lining material 40 is the ballistic panel 42 which comprises the individual layers of ballistic material 44 located within a covering layer 46. Layer 46 comprises a top layer 48 and a bottom layer 50 stitched together at internal seam 52. Gaps are shown in FIG. 8 between lining material 40 and top and bottom layers 48 and 50, and between layers 48 and 50 and ballistic material 44 only so that these components can be easily illustrated. It is to be understood that in the actual vest no gaps are present so that ballistic protection extends virtually from edge to edge in the front and rear panels.

As shown in FIGS. 1 and 4 the lining material 40 extends around to the outside surface of the vest and is sewn to the outside surface of the front and rear panels 18 and 20 to form a seam 54 which allows the ballistics package to extend all the way to the edge of the front and rear panels. As a result, the ballistics package provides more protective surfaces and thus a more protective body armor is created.

Figure 7:
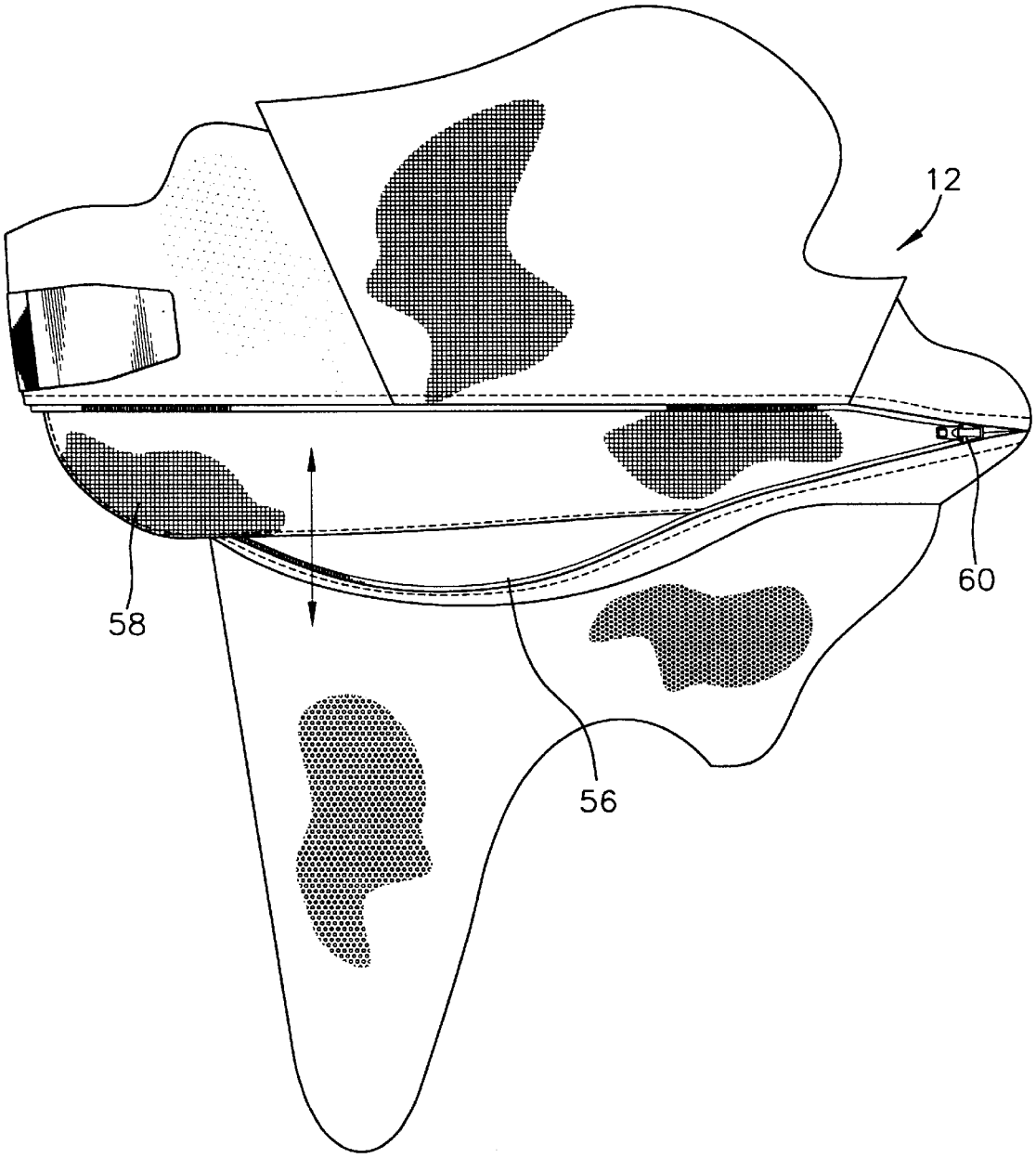
FIG. 7 is a detail of FIG. 1 illustrating the access to the ballistics panel or package.

As shown in FIG. 7, the front panel 12 includes an opening 56 for access to the ballistics panel 58. The opening is positioned on the outside of the front panel to produce a smooth surface against the body. A zipper 60 or other suitable closing mechanism extends across the width of the opening. The zipper permits easy access to remove the ballistic panel or package.

As seen in FIG. 4 the ballistic vest includes visual inspection ports 62 positioned on the exterior of the garment. In FIG. 4 the visual inspection ports are located on the outside surface of the back panel. Inspection ports allows the wearer to see that the ballistic package or panel is in place without opening the garment, thus improving the level of safety. The visual inspection ports are two mesh windows, or other suitable window material by which the ballistic panel can be viewed.

As shown in FIG. 1 retention tails 64 and 66 are sewn to the lower edge of the front and rear panels respectively. Preferably the tails are constructed of stretchable fabrics or meshes which are tucked into a wearers trousers to hold the vest down during movement. Considering the fabric is made of a stretchable material, the tails improve freedom of movement while holding the vest in place when sitting or standing.

Figures 9A, 9B:
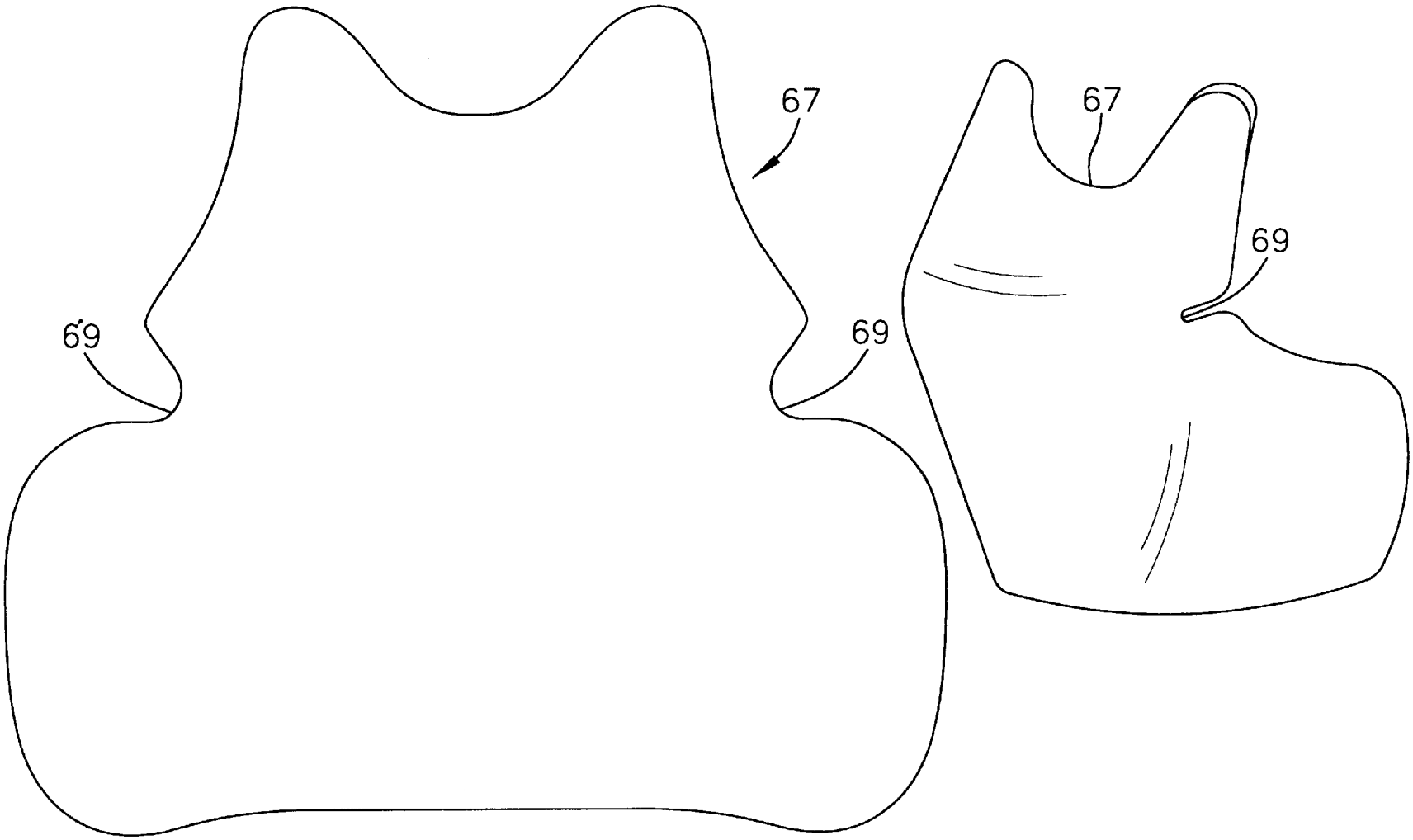
FIG. 9A is a front view of a female ballistic panel of the present invention.
FIG. 9B is a perspective view of the ballistic panel of FIG. 9A shown as configured when worn.

FIGS. 9A and 9B illustrate a front ballistic panel 67 for a female. Panel 67 can be constructed in a flat configuration as shown in FIG. 9A which eliminates the need for pleats, darts or seams to accommodate the bust. The panel incorporates a notch 69 on either side of the panel so that when the panel is worn it can conform to the bust without uncomfortable folds or overlap as shown in FIG. 9B. Varying the size of the notch can accommodate differences in bust size.

Figure 10:
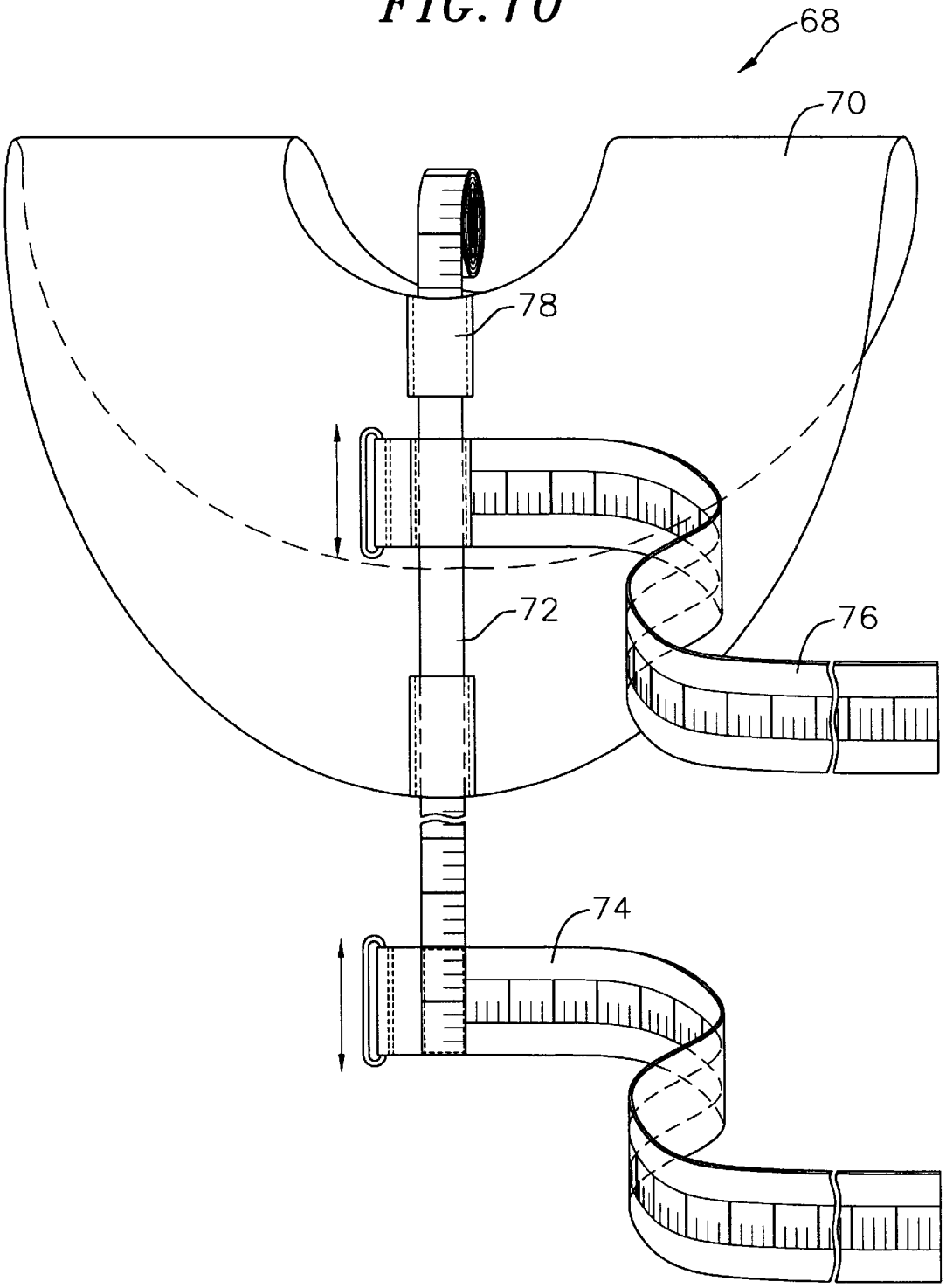
FIG. 10 is a front view of a measuring device of the present invention.

Considering the ballistic vest of the present invention can accommodate various body types, a novel measuring device has been developed for use in obtaining the measurements of particular wearers. The measuring device 68 is shown in FIG. 10. The measuring device includes a yoke 70 which fits over the head of the wearer and rests on the shoulders. Torso 72, waist 74, and bust measuring tapes are attached to the yoke for taking the torso, waist and bust measurement of the wearer. Based upon the torso and waist measurement of a male, the exact ballistic vest can be produced. For a female the torso, waist and bust measurements are necessary to produce the appropriate ballistic vest. The torso measuring tape 72 is secured through a sleeve 78 on the yoke which allows the measuring tape to slide vertically. The waist measuring tape is secured to the end of the torso measuring tape. The bust measuring tape 76 similarly is attached to the front of the yoke.

Although the present invention has been shown and illustrated with a preferred and alternative embodiments thereof, the invention is not to be so limited since changes and modifications can be made therein which are within the scope of the invention as hereinafter claimed.

What is claimed is:

1. A ballistic vest comprising:

a front panel;

a rear panel;

the front and rear panels have mating side portions wherein one of the front or rear panel mating side portion has a concave edge surface and the other mating side portion has a convex edge surface; and connectors for rigidly attaching the front panel to the rear panel.

2. The vest of claim 1 wherein the front panel has a concave waistline.

3. The vest of claim 1 wherein the front panel has a convex waistline.

4. The vest of claim 1 wherein the front and rear panels include a moisture wicking lining which moves moisture to an outside surface of the front and rear panels.

5. The vest of claim 1 wherein the front and rear panels comprise an outer carrier and a ballistic panel positioned within the carrier.

6. The vest of claim 5 wherein the carrier has a seam on the outside of the panels so that the ballistic panel can extend to the edge of the carrier.

7. The vest of claim 1 wherein the connectors are multi-directional elastomeric straps.

8. The vest of claim 7 wherein the straps are neoprene.

9. A ballistic vest comprising a front panel and a rear panel connected by straps wherein the front panel has a trapezoidal center section and fastener material positioned around the trapeziodal center section for attachment of the straps.

10. The vest of claim 4 wherein the lining is a single component.

11. The vest of claim 5 wherein the front panel has an opening in the carrier on an exterior surface of the carrier for access to the ballistic panel.

12. The vest of claim 5 wherein either the front or rear panel has at least one visual inspection port in the carrier to view the ballistic panel.

13. The vest of claim 1 wherein either the front or the rear panel has a pocket on an outside surface for insertion and removal of the connectors.

14. The vest of claim 1 further comprising a stretchable tail extending from a lower surface of at least one of the front or rear panels.

15. The vest of claim 5 wherein the ballistic panel for the front panel includes a notch on each side edge to allow the ballistic panel to conform to a female bust.

16. A ballistic vest comprising:

a front panel having a concave waistline extending substantially across a width of the front panel;

a real panel; and straps for attaching the front panel to the rear panel.

17. A ballistic vest comprising:

a front panel having a convex waistline;

a rear panel; and straps for attaching the front panel to the rear panel, wherein the front panel has a trapezoidal center section for receipt of the straps.

18. A ballistic vest comprising:

a front panel having an outer carrier and a ballistic package contained within the outer carrier;

a rear panel having an outer carrier and a ballistic package contained within the outer carrier;

the outer carrier of at least one of the front and rear panels having a moisture wicking lining which extends around an edge of the ballistic package to wick moisture to an outside surface of the front and/or rear panels; and straps for releasably attaching the front and rear panels.

19. A ballistic vest comprising:

a front panel having a carrier and a ballistic package contained within the carrier;

a rear panel having a carrier and a ballistic package contained within the carrier;

the carrier of at least one of the front and rear panels includes a one-piece lining which extends around an edge of the ballistic package and forms a seam on an outside surface of the front and/or rear panel so that the ballistic package extends to the edge of the carrier.

20. A ballistic vest comprising:

a front panel;

a rear panel;

a perforated stretchable tail attached to a lower edge of at least one of the front and/or rear panels; and straps for releasably attaching the front and rear panels.

21. A ballistic vest comprising:

a front panel having a carrier and a ballistic package positioned within the carrier;

the ballistic package including a notch positioned along each side edge and extending inwardly toward a center of the ballistic package; and a rear panel releasably attached to the front panel.

22. A ballistic vest comprising:

a front panel having a carrier and a ballistic package positioned with the carrier;

a rear panel having a carrier and a ballistic package positioned within the carrier; and straps for connecting the front panel to the rear panel, wherein the carrier of the rear panel has at least one pocket from which one end of the straps adjustably extends therefrom.

23. A ballistic vest comprising:

a front panel having a carrier and a ballistic package positioned within the carrier;

a rear panel having a carrier and a ballistic package positioned within the carrier; and straps for connecting the front panel to the rear panel, wherein at least one of the carriers of the front or rear panels has an opening on an exterior of the carrier extending substantially along a width of the carrier, adjacent a waistline of the carrier for insertion and removal of the ballistic package.

24. The vest of claim 23 wherein the opening includes a fastener for securely closing the opening.

* * * * *